US006280073B1

(12) United States Patent
Dillman

(10) Patent No.: US 6,280,073 B1
(45) Date of Patent: Aug. 28, 2001

(54) ROTARY ELEVATOR FOR FEEDING AGGREGATE FROM A DRUM DRYER TO A MIXING DRUM

(75) Inventor: Bruce A. Dillman, Cape Coral, FL (US)

(73) Assignee: Dillman Equipment, Inc., Prairie du Chien, WI (US)

( * ) Notice: Subject to any disclaimer, the term of this patent is extended or adjusted under 35 U.S.C. 154(b) by 0 days.

(21) Appl. No.: 09/594,580

(22) Filed: Jun. 9, 2000

(51) Int. Cl.[7] ..... B28C 5/46; B28C 7/14

(52) U.S. Cl. ..... 366/25; 366/30

(58) Field of Search ..... 366/7, 22–25, 366/27, 30, 53–59; 34/135–137; 432/106, 117, 118

(56) References Cited

U.S. PATENT DOCUMENTS 4,142,803 * 3/1979 Mendenhall ..... 366/25
4,427,376 * 1/1984 Etnyre et al. ..... 366/25
4,616,934 * 10/1986 Brock ..... 366/22
4,940,334 * 7/1990 Musil ..... 366/59
4,946,283 * 8/1990 Musil ..... 366/25
4,954,995 * 9/1990 Marconnet ..... 432/118
5,294,197 * 3/1994 Prill et al. ..... 366/23
5,397,177 * 3/1995 Swisher, Jr. ..... 366/25
5,556,197 * 9/1996 Loesch ..... 366/22

FOREIGN PATENT DOCUMENTS

278593 * 10/1914 (DE) ..... 366/24

* cited by examiner

*Primary Examiner*—Charles E. Cooley
(74) *Attorney, Agent, or Firm*—Wallenstein & Wagner, Ltd.

(57) ABSTRACT

A rotary aggregate elevator for use in an asphalt plant comprising a rotating dryer drum for drying aggregate having an inlet end and an outlet end, a rotating mixing drum having an inlet end and an outlet end, and further having an inlet for dried aggregate at its inlet end for receiving dried aggregate, an annular collar attached to the inlet end of the mixing drum for receiving aggregate discharged from the outlet end of the dryer drum, the annular collar having flights attached to its inner wall to lift dried aggregate to the inlet of the mixing drum as it rotates.

4 Claims, 3 Drawing Sheets

ROTARY ELEVATOR FOR FEEDING AGGREGATE FROM A DRUM DRYER TO A MIXING DRUM

TECHNICAL FIELD

The present invention relates generally to asphalt producing. More specifically, it relates to the use of a rotary elevator to elevate dried aggregate to a mixing drum where it will be combined with liquid asphaltic concrete.

BACKGROUND OF THE INVENTION

During the asphalt making process, it is necessary to dry aggregate before mixing it with asphaltic concrete. This can be accomplished with a dryer drum that is separate from an asphalt mixing drum. Because gravity is used to move aggregate through the dryer drum, its aggregate discharge is typically at the bottom of the outlet end of the drum. Different methods of elevating the aggregate for introducing it to the inlet of the mixing drum have been used. These methods include a vertical bucket elevator, an inclined slat conveyor, and elevating the drying drum so that its discharge can feed to the inlet of the mixing drum.

SUMMARY OF THE INVENTION

The present invention comprises a rotary elevator attached to the mixing drum to lift the aggregate exiting the dryer drum to the inlet of the mixing drum. This would provide a simpler, more economical method of aggregate transfer than the methods currently used.

An additional object of the present invention is to provide an elevator that will provide additional area for the superheated virgin aggregate to combine with recycled asphalt materials. The additional space will provide premixing that will improve the heat transfer process during mixing.

Another object of the present invention is to provide a portable asphalt plant that has less equipment to move than existing plants with a separate mixer, resulting in reduced set up time. Further, the present invention has no moving parts, and is virtually maintenance free.

These and other features of the present invention are discussed or apparent in the following detailed description.

DETAILED DESCRIPTION OF THE PREFERRED EMBODIMENT

Figure 1:
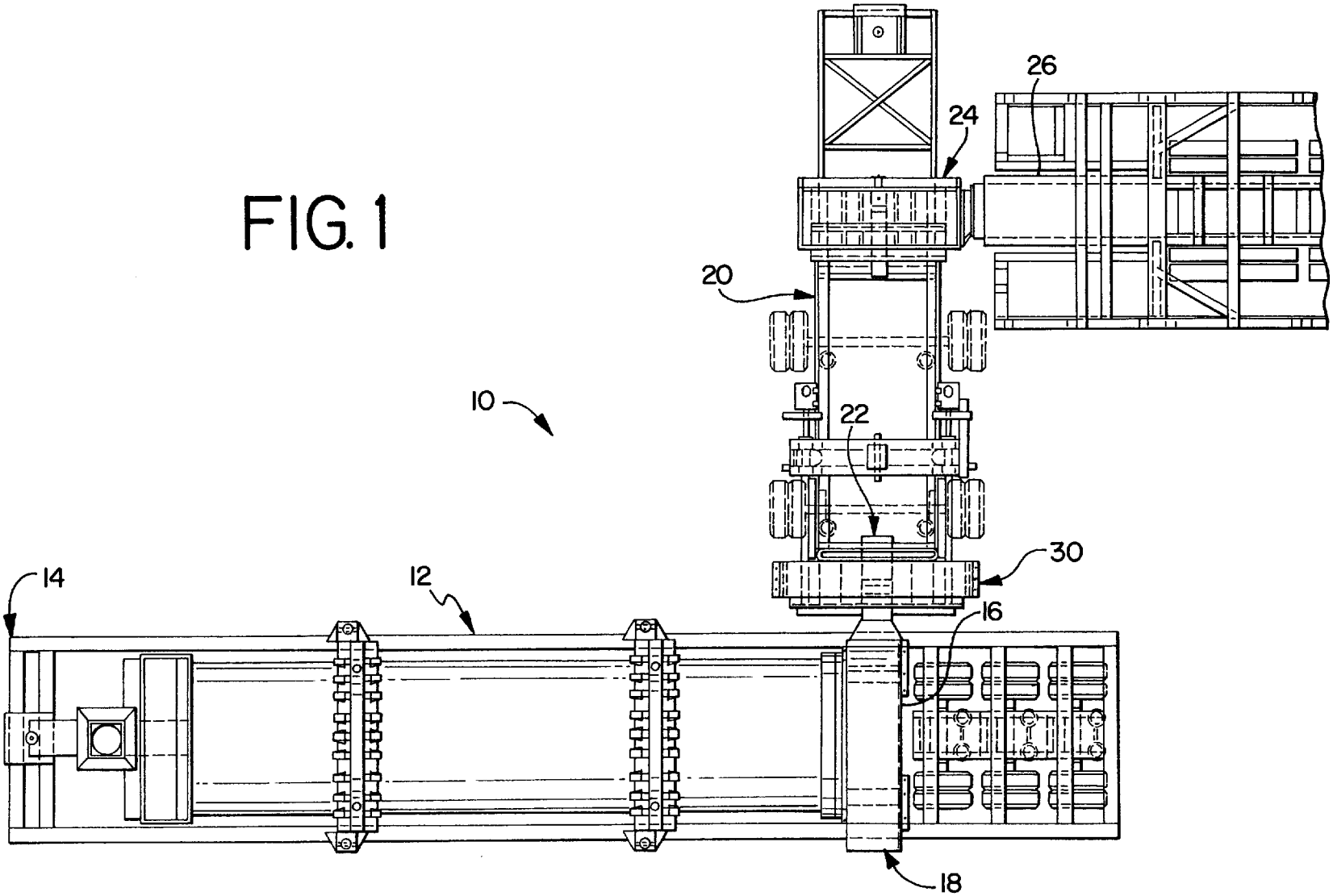
FIG. 1 is a perspective view of a mobile asphalt plant incorporating the rotary elevator of the present invention.

While this invention is susceptible of embodiments in many different forms, there is shown in the drawings and will herein be described in detail, a preferred embodiment of the invention with the understanding that the present disclosure is to be considered as an exemplification of the principles of the invention and it is not intended to limit the broad aspects of the invention to the embodiment illustrated.

Referring to FIG. 1, a typical mobile asphalt plant 10 is shown. The present invention is designed primarily to be used with asphalt plants that use separate drums to dry aggregate and to mix it with asphaltic concrete to make asphalt. It will be understood that the invention may also be used with stationary asphalt plants. The plant 10 comprises an aggregate dryer drum 12 having an inlet end 14 and outlet end 16. Aggregate is placed in the inlet end 14, and is dried as it travels through the dryer drum 12. Dried aggregate exits from the outlet end 16. Recycled asphalt product (RAP) can also be introduced into the aggregated dryer through an inlet 18 if desired.

The plant 10 also includes a mixing drum 20 having an inlet end 22 and outlet end 24. The inlet end 22 of the mixing drum 20 is arranged so that it is integrated with the outlet end 16 of the dryer drum 12 so that aggregate exiting the dryer drum 12 enters the inlet end 22 and is mixed with asphaltic concrete as it travels through the mixing drum 20 to the outlet end 24 where it exits the mixing drum 20 to typically be conveyed by a conveyor 26 to a silo (not shown) for storage.

Figure 2:
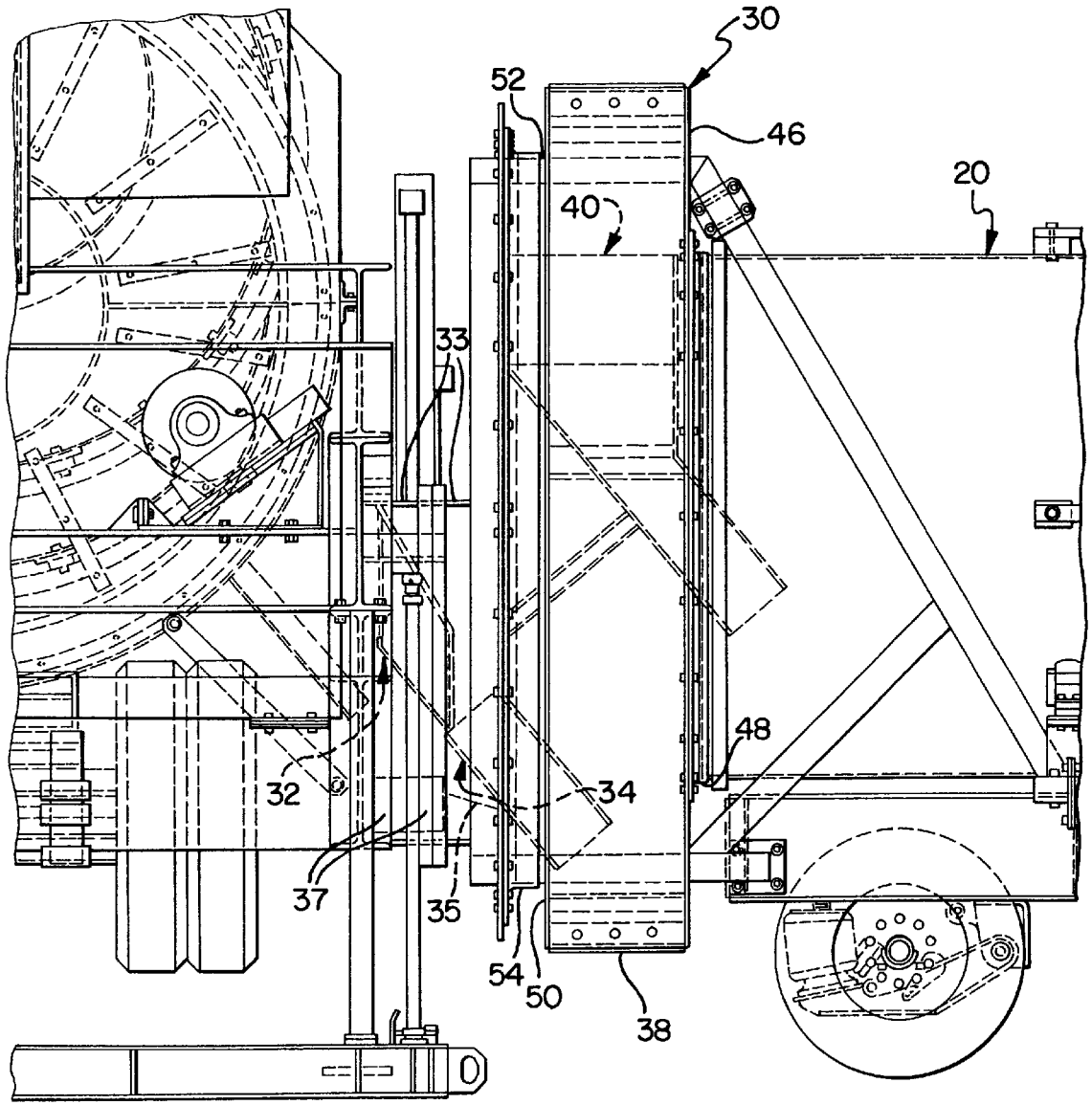
FIG. 2 is a end view of the dryer drum showing the rotary elevator of the present invention attached to the mixing drum.
Figure 3:
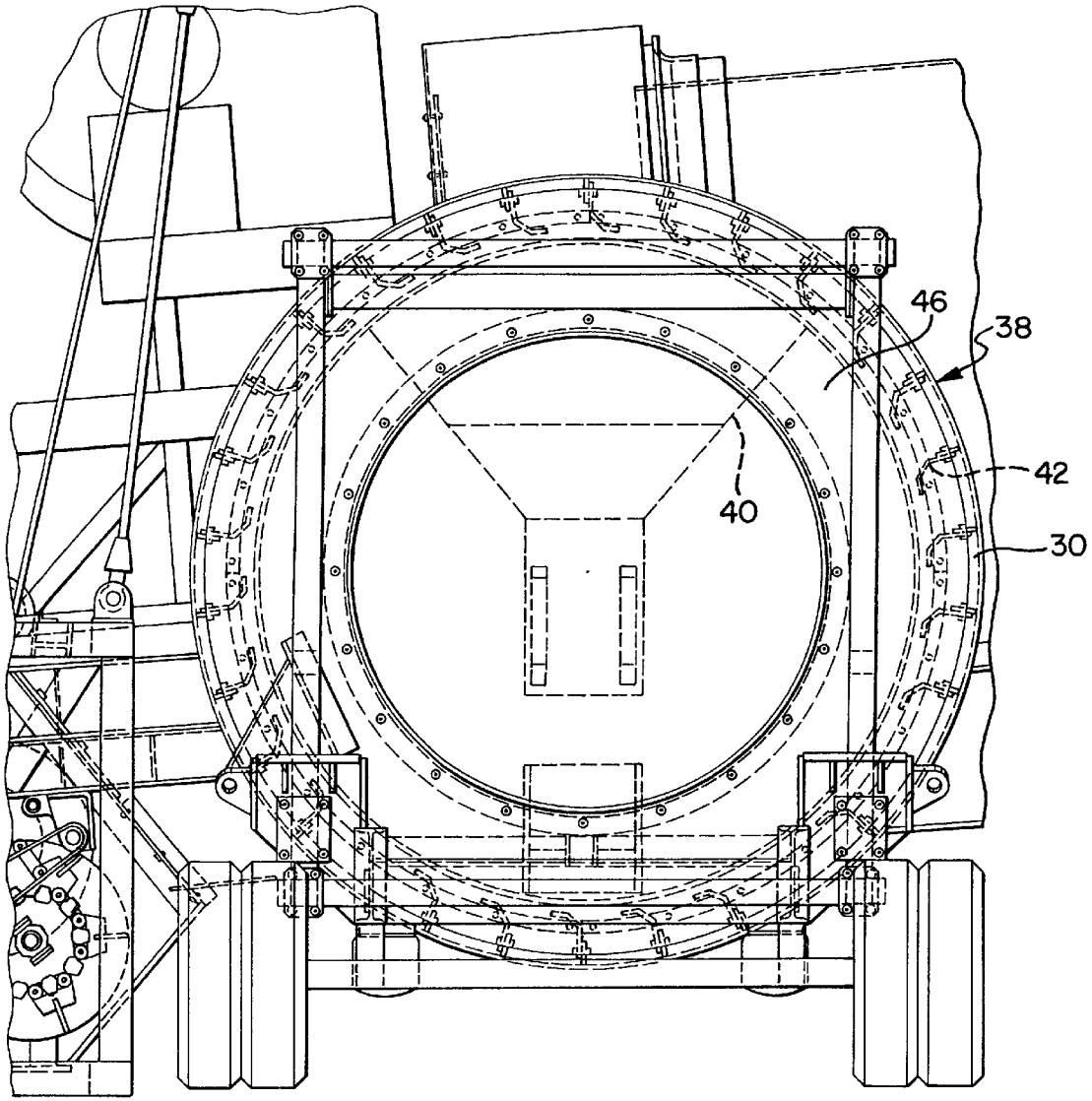
FIG. 3 is an end view of the mixing drum showing the rotary elevator of the present invention.

The rotary elevator 30 of the present invention is located at the inlet end 22 of the mixing drum 20. FIG. 2 shows the outlet end 16 of the dryer drum 12 having a dryer discharge 32 from where dried aggregate exits from the dryer drum 12. The discharge 32 has connected to it a chute 34 for directing the dried aggregate to the rotary elevator 30. The rotary elevator comprises an annular collar 38 sized to fit the inlet end 22 of the mixing drum 20. The collar 38 is made from the same material as the mixing drum 20, typically steel, but is larger than the diameter of the mixing drum 20. The collar 38 also is large enough to encircle the inlet 40 of the mixing drum 20.

Attached to the inside of the collar 38 are flights 42 which extend the width of the collar 38. The flights 42 are designed so that they lift aggregate from the discharge 32 of the dryer drum 12. The flights 42 are typically bolted to the inside of the collar 38, and radiate generally inward to the center of the collar 38. Any flight design that accomplishes this purpose will suffice.

The collar 38 has a back wall 46 extending inwardly from the collar 38 that is bolted to a mounting ring 48 that is in turn attached to the inlet end 22 of the mixing drum 20. This secures the collar 38 to the mixing drum 20. The collar 38 also has a front wall 50 at its end closest to the dryer drum 12. The front wall 50 extends inward from the collar 38 to create an annular flange 52 that extend coaxially with the collar 38. An inlet seal ring 54 attaches to the flange 52 by bolts.

To seal the area of the discharge 32 and the inlet of the collar 38, mating flanges 33 with a sponge material 35 glued thereto are provided. To ensure alignment of the discharge 32 and inlet of the collar 38, alignment bars 37 are provided.

In operation, the rotary elevator 30 of the present invention works as follows. Aggregate is introduced at the inlet end 14 of the dryer drum 12. The dryer drum 12 is inclined so that the inlet end 14 is higher than its outlet end 16, permitting gravity to assist in pushing the aggregate through the dryer drum 12 as it rotates. If desired, RAP can be introduced to the dryer drum 12 through inlet 18. The use of a dryer drum 12 to dry aggregate and introduce RAP is well known in the art. After the aggregate, and possibly RAP, is dried in the dryer drum 12, it exits at the outlet end 14 through discharge 32. The aggregate is guided by chute 34 through the inlet seal ring 54 to the bottom of the collar 38 of the rotary elevator 30.

The mixing drum 20, like the dryer drum 12, rotates, and is higher at its inlet end 22 that its outlet end 24 to permit gravity to assist in moving the aggregate through the mixing drum 20. Because the collar 30 is attached to the mixing drum 20, it rotates with the mixing drum. Flights 42 located along the inside of the collar 38 lift the aggregate to the inlet 40 of the mixing drum 20. Aggregate then is released by the flights 42, and falls inside the inlet 40 and is, thus, introduced to the mixing drum 20. Aggregate is prevented from backing out of the collar 38 by the front wall 50.

A preferred embodiment of the present invention is described herein. It is to be understood, of course, that changes and modifications may be made in the embodiment without departing from the true scope and spirit of the present invention as defined by the appended claims.

I claim:

1. A rotary aggregate elevator for use in an asphalt plant comprising:

a rotating dryer drum for drying aggregate having an inlet end and an outlet end;

a rotating mixing drum having an inlet end and an outlet end, and further having an inlet for dried aggregate at its inlet end for receiving dried aggregate; and an annular collar attached to the inlet end of the mixing drum for receiving aggregate discharged from the outlet end of the dryer drum, the annular collar having flights attached to its inner wall to lift dried aggregate to the inlet of the mixing drum as it rotates.

2. The rotary aggregate elevator of claim 1 further comprising an inlet located along the length of the dryer drum for introducing recycled asphalt product to the dryer drum.

3. A rotary aggregate elevator for use in an asphalt plant comprising:

a rotating dryer drum for drying aggregate having an inlet end and an outlet end;

a rotating mixing drum having an inlet end and an outlet end, and further having an inlet for dried aggregate at its inlet end for receiving dried aggregate;

an annular collar having a back wall and a front wall, wherein the back wall extends inward from the collar, and the front wall extends inward from the collar to create an annular flange that extends coaxially with the collar, the annular collar also having flights attached to its inner wall to lift dried aggregate to the inlet of the mixing drum as it rotates; and an inlet seal ring attached to the flange.

4. The rotary aggregate elevator of claim 3 wherein a mounting ring is attached to the back wall of the collar to in turn attach the collar to the inlet end of the mixing drum.

* * * * *